US009120213B2

(12) United States Patent
Elger

(10) Patent No.: US 9,120,213 B2
(45) Date of Patent: Sep. 1, 2015

(54) POWERED RATCHET WRENCH

(75) Inventor: William Elger, West Bend, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 890 days.

(21) Appl. No.: 13/355,179

(22) Filed: Jan. 20, 2012

(65) Prior Publication Data

US 2012/0186400 A1 Jul. 26, 2012

Related U.S. Application Data

(60) Provisional application No. 61/435,124, filed on Jan. 21, 2011.

(51) Int. Cl.

| | |
|---|---|
| ***B25B 13/00*** | (2006.01) |
| ***B25B 21/00*** | (2006.01) |
| ***B25B 13/46*** | (2006.01) |

(52) U.S. Cl.

CPC ..... *B25B 21/004* (2013.01); *B25B 13/465* (2013.01)

(58) Field of Classification Search

CPC ..... B25B 21/00; B25B 21/02; B25B 21/002; B25B 21/004; B25B 13/467; B25B 13/481; B25B 13/463; B25B 13/465; B25B 17/00; B25B 23/0035; B23P 19/06

USPC ..... 81/54, 57.13, 57.14, 57.3, 57.29, 57.39, 81/62, 63, 63.1, 63.2

See application file for complete search history.

(56) References Cited

U.S. PATENT DOCUMENTS

| | | | | |
|---|---|---|---|---|
| 2,217,740 | A | | 10/1940 | Ehnts |
| 2,483,544 | A | | 10/1949 | Jacobsen |
| 2,764,048 | A | | 9/1956 | Thompson |
| 2,982,161 | A | | 5/1961 | Angquist et al. |
| 3,295,262 | A | | 1/1967 | Brown |
| 3,372,612 | A | | 3/1968 | Rozmus |
| 3,467,231 | A | | 9/1969 | Haznar |
| 3,498,186 | A | | 3/1970 | Northcutt |
| 3,529,498 | A | | 9/1970 | Northcutt |
| 3,614,182 | A | | 10/1971 | Rozentals |
| 3,642,389 | A | | 2/1972 | Chambers et al. |
| 3,935,909 | A | | 2/1976 | Mabuchi et al. |
| 4,001,937 | A | | 1/1977 | Stelljes et al. |
| 4,116,093 | A | | 9/1978 | DePagter |
| 4,346,630 | A | * | 8/1982 | Hanson ..... 81/57.13 |
| 4,374,480 | A | | 2/1983 | Diaz |
| 4,448,098 | A | | 5/1984 | Totsu |

(Continued)

OTHER PUBLICATIONS

Ingersoll Rand, R380 and R385 Cordless Ratchet Wrench Exploded Diagram, and Parts List, (2007), Edition 2, 2 pages.

(Continued)

*Primary Examiner* — Lee D Wilson
*Assistant Examiner* — Melanie Alexander
(74) *Attorney, Agent, or Firm* — Michael Best & Friedrich LLP

(57) ABSTRACT

A power tool includes a motor having a motor drive shaft, a drive assembly coupled to the motor drive shaft and driven by the motor, an output assembly coupled to the drive assembly and having an output member, and a first housing that houses at least a portion of the motor and at least partially defines an outer surface of the power tool. The first housing is formed from steel for reducing flux losses of the motor. The power tool also includes a second housing disposed around an outer surface of the first housing. The second housing is formed from plastic and includes a grip portion.

21 Claims, 10 Drawing Sheets

(56) References Cited

U.S. PATENT DOCUMENTS

| | | | | |
|---|---|---|---|---|
| 4,507,990 | A | 4/1985 | Lack | |
| 4,720,000 | A | 1/1988 | Snyder | |
| 4,807,500 | A | 2/1989 | Main | |
| 4,903,554 | A | 2/1990 | Colvin | |
| 4,905,772 | A | 3/1990 | Honsa et al. | |
| 4,974,475 | A | 12/1990 | Lord et al. | |
| 4,987,803 | A | 1/1991 | Chern | |
| 5,009,132 | A | 4/1991 | Gilberto | |
| 5,022,289 | A | 6/1991 | Butzen | |
| 5,054,584 | A | 10/1991 | Hoffman | |
| 5,086,673 | A | 2/1992 | Korty | |
| 5,140,874 | A | 8/1992 | Junkers | |
| 5,142,952 | A * | 9/1992 | Putney et al. | 81/57.39 |
| 5,178,047 | A | 1/1993 | Arnold et al. | |
| 5,199,330 | A | 4/1993 | Arnold et al. | |
| 5,231,901 | A | 8/1993 | Putney et al. | |
| 5,237,885 | A * | 8/1993 | Putney et al. | 74/116 |
| 5,251,706 | A | 10/1993 | Evans | |
| 5,269,733 | A | 12/1993 | Anthony, III | |
| 5,301,574 | A | 4/1994 | Knopp et al. | |
| 5,309,714 | A | 5/1994 | Putney et al. | |
| 5,425,291 | A | 6/1995 | Chang | |
| 5,450,773 | A | 9/1995 | Darrah et al. | |
| 5,535,646 | A | 7/1996 | Allen et al. | |
| 5,537,899 | A | 7/1996 | Diedrich | |
| 5,630,343 | A | 5/1997 | Begin | |
| RE35,617 | E | 9/1997 | Krivec | |
| 5,697,267 | A | 12/1997 | Tsai | |
| 5,875,693 | A | 3/1999 | Zurbuchen et al. | |
| 5,896,789 | A | 4/1999 | Giardino | |
| 5,967,243 | A | 10/1999 | Jacobsson | |
| 5,983,757 | A | 11/1999 | Blise et al. | |
| 5,992,539 | A | 11/1999 | Lin | |
| 6,067,881 | A | 5/2000 | Albertson | |
| 6,203,737 | B1 | 3/2001 | Zurbuchen | |
| 6,205,891 | B1 | 3/2001 | Huang et al. | |
| 6,209,422 | B1 | 4/2001 | Kamiya et al. | |
| 6,305,246 | B1 | 10/2001 | Horvath | |
| 6,311,584 | B1 | 11/2001 | Chu | |
| 6,457,386 | B1 | 10/2002 | Chiang | |
| 6,490,953 | B2 | 12/2002 | Horvath | |
| 6,523,442 | B2 | 2/2003 | Lehnert et al. | |
| 6,528,921 | B1 | 3/2003 | Nakane | |
| 6,530,436 | B2 | 3/2003 | Nowak, Jr. et al. | |
| 6,578,643 | B2 | 6/2003 | Izumisawa | |
| 6,681,660 | B2 | 1/2004 | Foard | |
| 6,712,157 | B2 | 3/2004 | Hansson | |
| 6,715,380 | B2 | 4/2004 | Listl et al. | |
| 6,769,330 | B2 | 8/2004 | Chang | |
| 6,785,971 | B2 | 9/2004 | McDonnell | |
| 6,789,448 | B2 * | 9/2004 | Ono et al. | 81/57.39 |
| 6,871,711 | B2 | 3/2005 | Hansson | |
| 6,915,721 | B2 | 7/2005 | Hsu et al. | |
| 6,923,095 | B2 | 8/2005 | Horvath | |
| 7,059,217 | B2 | 6/2006 | Horvath | |
| 7,080,578 | B2 * | 7/2006 | Izumisawa | 81/57.39 |
| 7,082,860 | B2 | 8/2006 | Shu-Sui et al. | |
| 7,086,311 | B2 * | 8/2006 | Liaw | 81/57.39 |
| 7,131,205 | B2 | 11/2006 | McDonnell | |
| 7,168,340 | B1 | 1/2007 | Green | |
| 7,171,873 | B2 | 2/2007 | Horvath | |
| 7,223,195 | B2 | 5/2007 | Milbourne et al. | |
| 7,267,033 | B1 | 9/2007 | Lai | |
| 7,284,463 | B2 | 10/2007 | Decelles et al. | |
| 7,305,941 | B2 | 12/2007 | Akiba et al. | |
| 7,306,050 | B2 | 12/2007 | Chen | |
| 7,441,482 | B2 | 10/2008 | Lin | |
| 7,452,304 | B2 | 11/2008 | Hagan et al. | |
| 7,484,439 | B2 | 2/2009 | Lin | |
| 7,536,934 | B1 | 5/2009 | Tatangelo | |
| 7,619,387 | B2 | 11/2009 | Amend et al. | |
| 7,735,398 | B2 | 6/2010 | Hsu et al. | |
| 7,770,494 | B2 | 8/2010 | Cornwell et al. | |
| 7,793,568 | B2 | 9/2010 | Mitcheltree et al. | |
| 7,827,886 | B2 | 11/2010 | Hu | |
| 7,836,798 | B2 | 11/2010 | Hu | |
| 8,051,746 | B2 * | 11/2011 | Bouchard et al. | 81/57.39 |
| 2002/0148331 | A1 * | 10/2002 | Horvath | 81/57.39 |
| 2003/0213340 | A1 | 11/2003 | Alden | |
| 2003/0213341 | A1 | 11/2003 | Alden | |
| 2005/0039579 | A1 | 2/2005 | Wallace | |
| 2005/0061113 | A1 * | 3/2005 | Horvath | 81/57.39 |
| 2005/0284265 | A1 | 12/2005 | Baker | |
| 2006/0027048 | A1 | 2/2006 | Chen | |
| 2006/0236819 | A1 | 10/2006 | Lee | |
| 2007/0107560 | A1 | 5/2007 | Chiang | |
| 2007/0186729 | A1 | 8/2007 | Baker | |
| 2008/0000665 | A1 | 1/2008 | Kokinelis et al. | |
| 2008/0142329 | A1 | 6/2008 | Kobayashi | |
| 2008/0229887 | A1 | 9/2008 | Thompson et al. | |
| 2008/0229889 | A1 | 9/2008 | Hopper et al. | |
| 2009/0031865 | A1 | 2/2009 | Alberti et al. | |
| 2009/0194306 | A1 | 8/2009 | Johnson et al. | |
| 2009/0301265 | A1 | 12/2009 | Hu | |
| 2010/0011913 | A1 * | 1/2010 | Horvath et al. | 81/60 |
| 2010/0162857 | A1 | 7/2010 | Chang | |
| 2011/0272172 | A1 | 11/2011 | Lau et al. | |

OTHER PUBLICATIONS

Ingersoll Rand, Cordless Ratchets R140, R145, R380 and R385, brochure, (2007), 6 pages.

Ingersoll Rand, Cordless Ratchet Kit User Manual R140, R145, R380 and R385, manual, (2010), Edition 2, 52 pages.

MATCO, Infinium Cordless Ratchet MUC108R, brochure, (known at least as early as Jan. 21, 2011), 1 page.

* cited by examiner

POWERED RATCHET WRENCH

CROSS REFERENCE TO RELATED APPLICATION

This application claims priority to U.S. Provisional Patent Application Ser. No. 61/435,124, which was filed on Jan. 21, 2011, the entire contents of which are incorporated herein by reference.

BACKGROUND

The present invention relates to a powered ratchet wrench for applying a torque to a fastener for tightening or loosening the fastener.

Powered ratchet wrenches are typically powered by an electrical source, such as a DC battery, a conventional AC source, or by pressurized air. Powered ratchet wrenches are constructed of components such as a motor, a drive assembly driven by the motor and an output for applying torque to a fastener. When an electric motor is used, a steel flux ring is typically disposed around an outer circumference of the motor to improve motor efficiency. A housing encloses the components.

SUMMARY

In one aspect, the invention provides a power tool including a motor having a motor drive shaft, a drive assembly coupled to the motor drive shaft and driven by the motor, an output assembly coupled to the drive assembly and having an output member, and a housing that houses at least a portion of the motor and at least partially defines an outer surface of the power tool. The housing is formed from steel for reducing flux losses of the motor.

In another aspect, the invention provides a power tool including a motor having a motor drive shaft, a drive assembly coupled to the motor drive shaft and driven by the motor, an output assembly coupled to the drive assembly and having an output member, and a first housing. The first housing includes a first portion that houses at least a portion of the motor, a second portion that houses the drive assembly and a third portion that at least partially receives the output assembly. The housing is formed as one piece and is formed from a metal. The power tool also includes a second housing disposed around an outer surface of the first portion. The second housing is formed from plastic and includes a grip portion.

In another aspect, the invention provides a power tool including a motor having a motor drive shaft, a drive assembly coupled to the motor drive shaft and driven by the motor, the drive assembly including an eccentric member, and an output assembly coupled to the drive assembly. The output assembly includes a yoke coupled with the eccentric member for converting eccentric rotational motion of the eccentric member into oscillating rotational motion of the yoke, an output member coupled to the yoke, and a ratchet mechanism disposed between the yoke and the output member for coupling the yoke to the output member in a first rotational direction and ratcheting the yoke with respect to the output member in a second rotational direction. The power tool also includes a housing having a first portion for at least partially enclosing the motor and a second portion for at least partially receiving the yoke. The first and second portions are formed as one piece.

Other aspects of the invention will become apparent by consideration of the detailed description and accompanying drawings.

Figure 1:
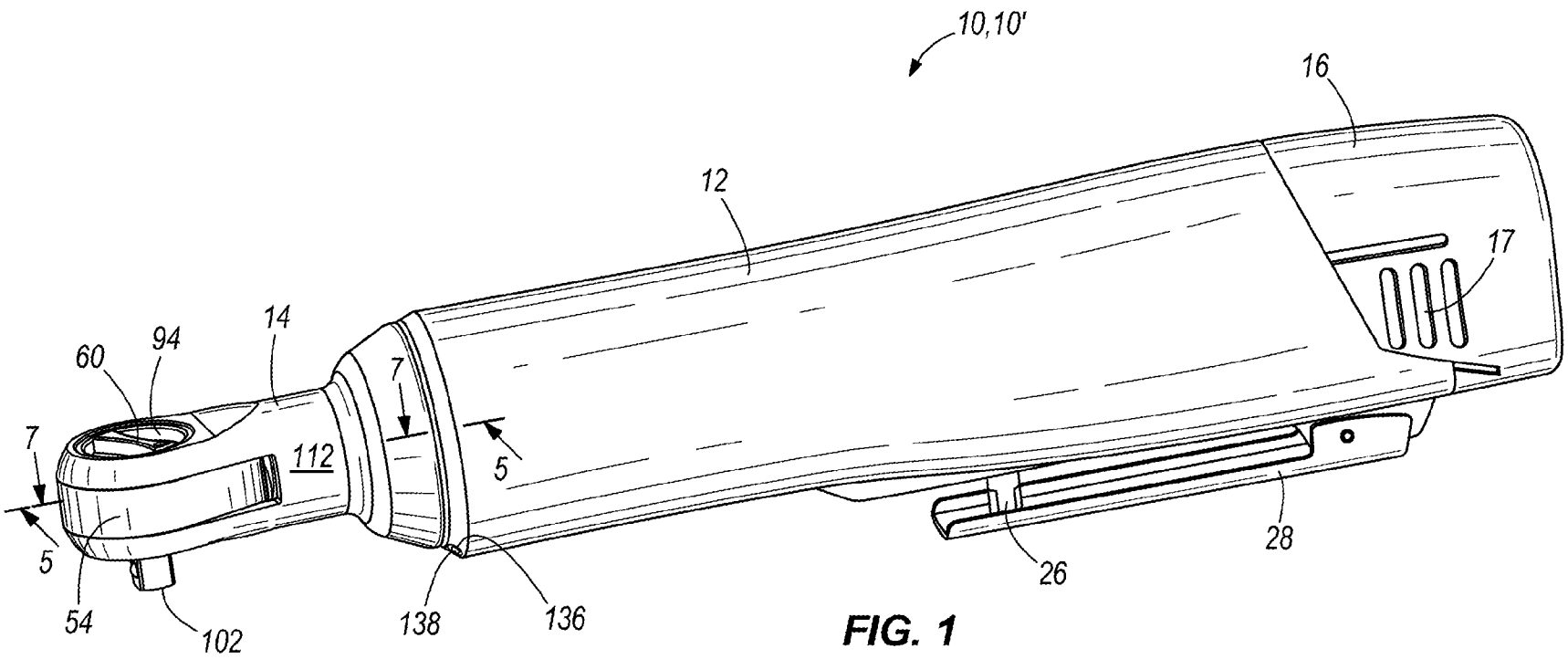
FIG. 1 is a perspective side view of a powered ratchet wrench according to one construction of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

FIGS. 1-5 illustrate a battery-powered hand-held ratchet wrench 10 according to one construction of the invention. The wrench 10 includes a main housing 12, a head housing 14, and a battery pack 16 received by the main housing 12. The battery pack 16 is a removable and rechargeable 12-volt battery pack and includes three (3) Lithium-ion battery cells. In other constructions, the battery pack may include fewer or more battery cells such that the battery pack is a 14.4-volt battery pack, an 18-volt battery pack, or the like. Additionally or alternatively, the battery cells may have chemistries other than Lithium-ion such as, for example, Nickel Cadmium, Nickel Metal-Hydride, or the like.

The battery pack 16 is inserted into a cavity in the main housing 12 in the axial direction of axis A and snaps into connection with the main housing 12. The battery pack 16 includes a latch 17, which can be depressed to release the battery pack 16 from the wrench 10. In other constructions, the wrench 10 includes a cord and is powered by a remote source of power, such as an AC utility source connected to the cord. In another construction, the wrench 10 may be a pneumatic tool powered by pressurized air flow through a rotary air vane motor, not shown. In this construction, instead of the battery pack 16 and electric motor 18, the wrench 10 includes a rotary air vane motor (not shown) and a connector (not shown) for receiving pressurized air. In other constructions, other power sources may be employed.

Figure 6:
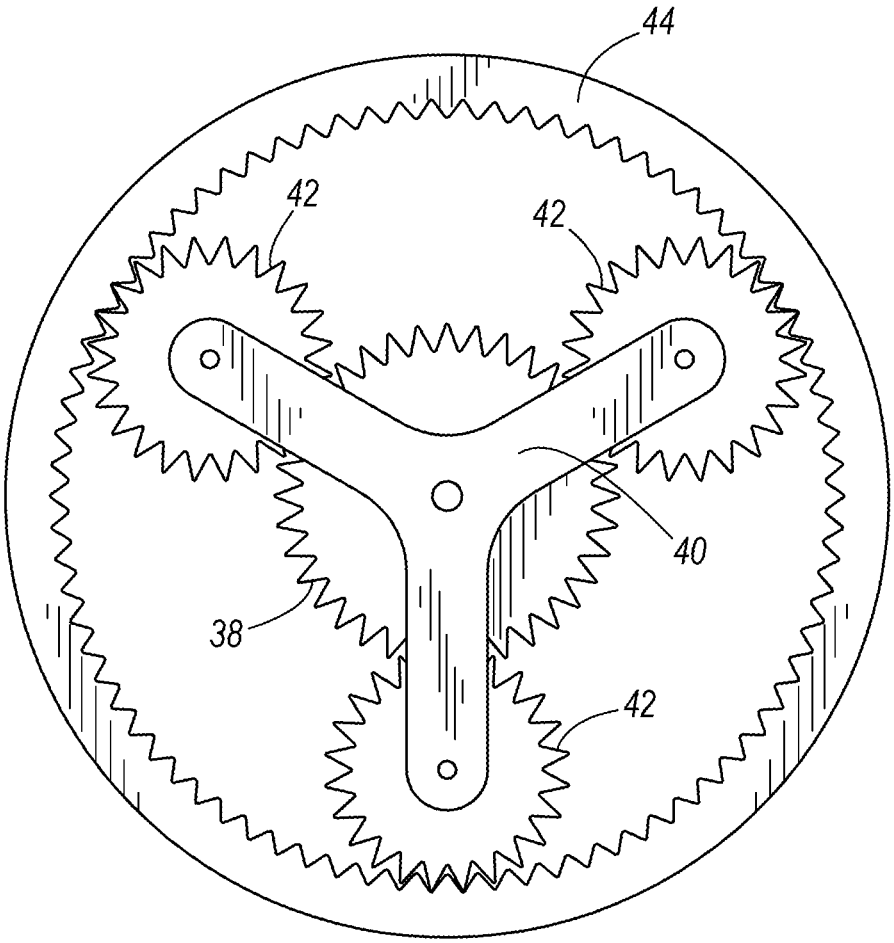
FIG. 6 is a schematic view of an epicyclic gear arrangement.

FIG. 6 illustrates an epicyclic gearing system including a sun gear 38, a planet carrier 40 or cage, three planet gears 42, and a ring gear 44. Several epicyclic gearing arrangements are possible with these components. For example, in a planetary gear arrangement, the sun gear 38 rotates, the cage 40 rotates and the ring gear 44 is fixed. In a star gear arrangement, the sun gear 38 rotates, the cage 40 is fixed and the ring gear 44 rotates.

Figure 8:
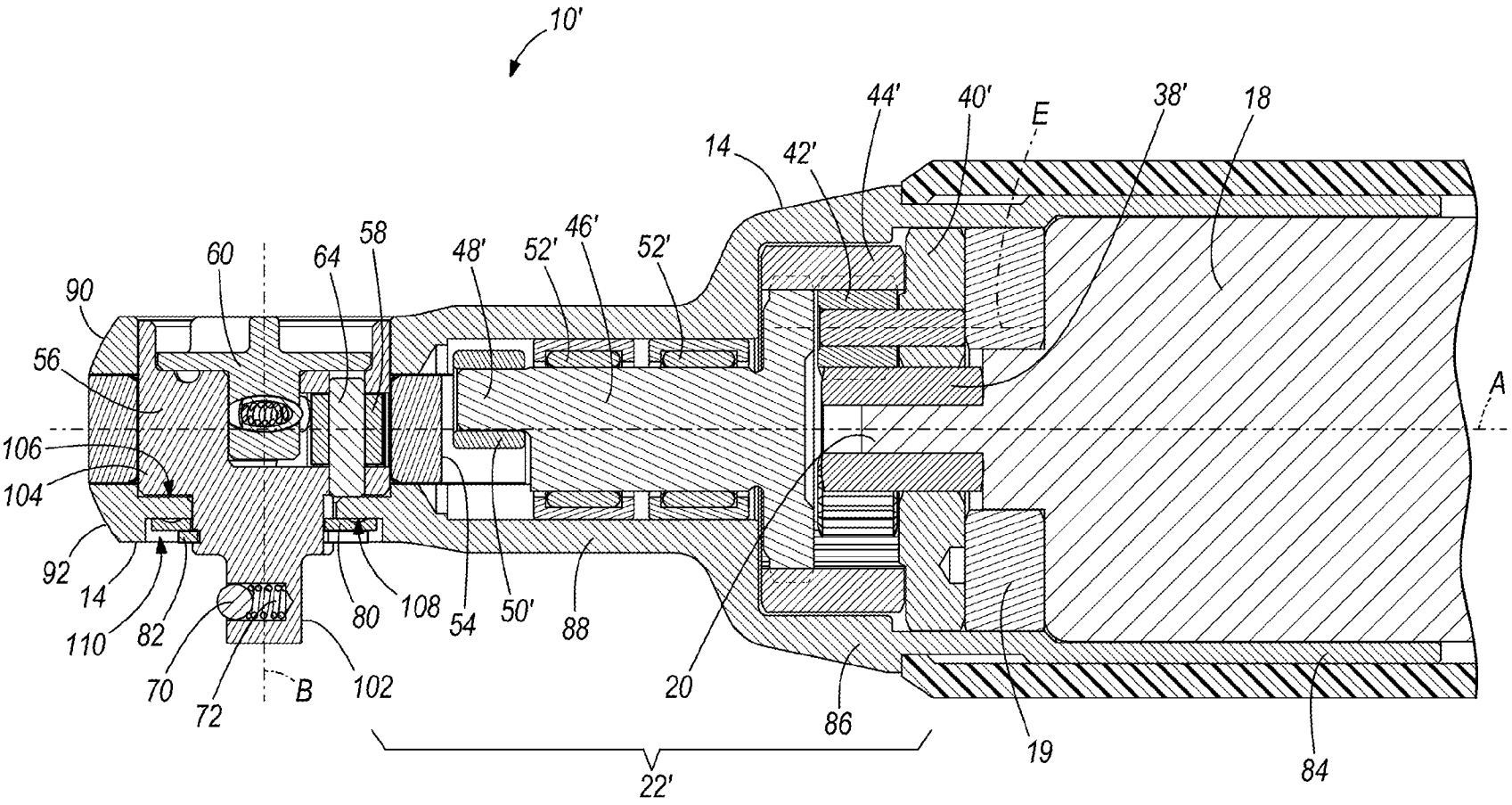
FIG. 8 is a cross-sectional view of another construction of a powered ratchet wrench.

FIGS. 2-5 illustrate the wrench 10 employing the planetary gear arrangement. FIG. 8 is a cross-section view of another construction of a wrench 10' employing the star gear arrangement. The wrench 10' is substantially the same as the wrench 10 except for the particular arrangement of epicyclic gearing. That is, the wrench 10 includes a drive assembly 22 having a planetary gear arrangement and the wrench 10' includes a drive assembly 22' having a star gear arrangement. The remaining description of the wrench 10' shown in FIG. 8 applies to the wrench 10, and vice versa, and will be given the same reference numerals.

Figure 2:
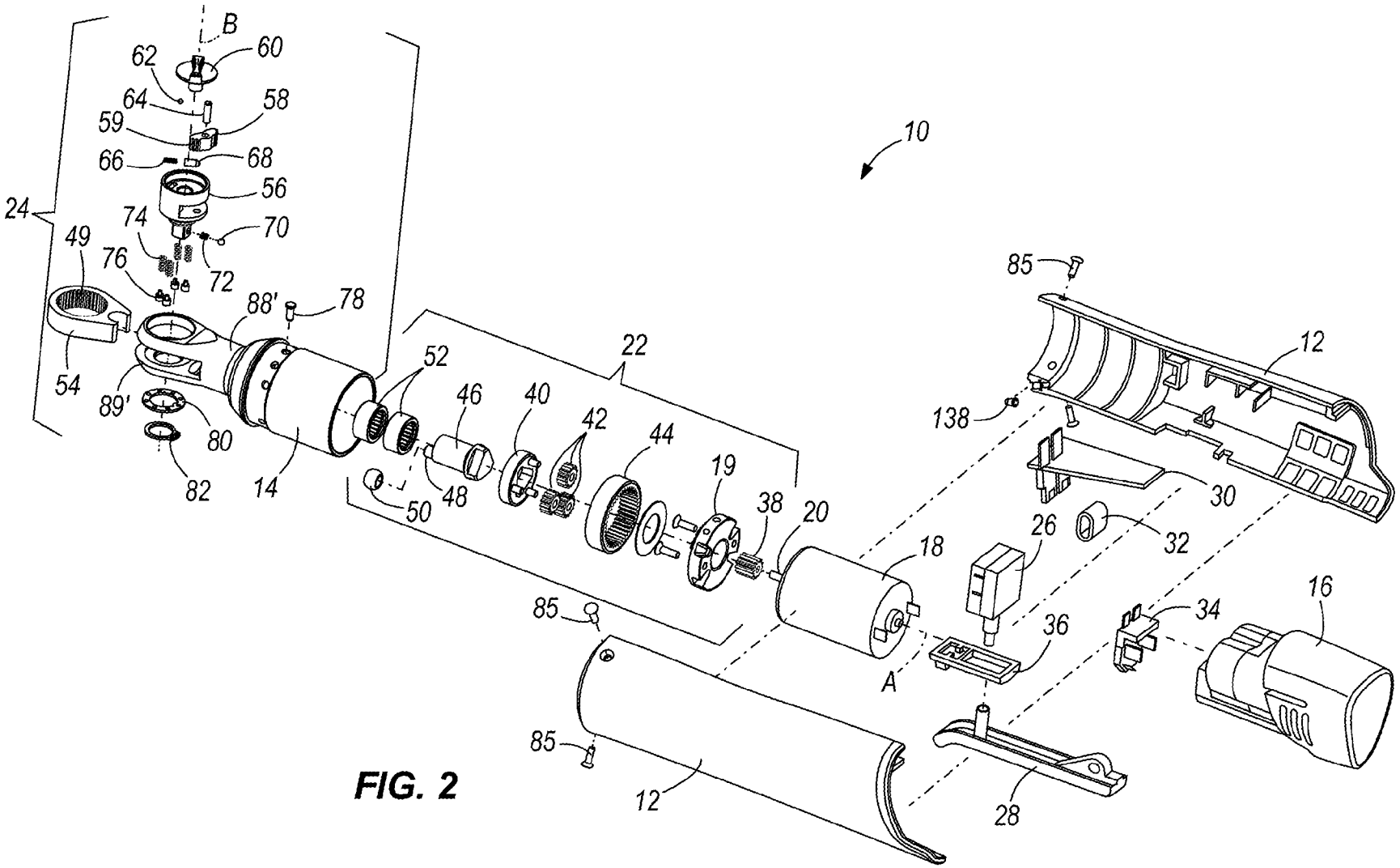
FIG. 2 is an exploded view of the powered ratchet wrench of FIG. 1.

The wrench 10, 10' includes a motor 18, a motor drive shaft 20 extending from the motor 18 and centered about the axis A, and the drive assembly 22, 22' coupled to the drive shaft 20 for driving an output assembly 24. The motor 18 is mounted to a steel motor plate 19 and received in the head housing 14. The output assembly 24 defines a central axis B substantially perpendicular to axis A, and will be described in greater detail below. As illustrated in FIGS. 1-2, the wrench 10, 10' also includes a switch 26 for selectively connecting the motor 18 to the power source, a switch paddle 28 for actuating the switch 26, a printed circuit board assembly (PCBA) 30, a suppressor 32, a battery connector 34 for electrically connecting the battery pack 16 to the motor 18, and a lockout shuttle 36 for selectively blocking the switch 26 from actuation, for example, when the wrench 10, 10' is in storage. The switch paddle 28 is preferably made of plastic, is coupled with the main housing 12 and is depressible to actuate the switch 26 when in a depressed position. The switch paddle 28 is biased to a non-depressed position. The switch 26, when actuated, electrically couples the battery pack 16 and the motor 18 to run the motor 18.

In the ratchet wrench construction shown in FIGS. 2-5, the drive assembly 22 includes the sun gear 38, the planet carrier 40 or cage, the three planet gears 42, the ring gear 44, a crankshaft 46 having an eccentric member 48, a drive bushing 50, and two needle bearings 52. The sun gear 38 is coupled to the drive shaft 20 of the motor 18 for rotation therewith. In this construction, the ring gear 44 is fixed and the planet carrier 40 rotates with the planet gears 42 such that the planet gears 42 rotate about respective axes and follow a circular path. The planet gears 42 are driven by toothed engagement with the sun gear 38, which rotates with the drive shaft 20 by fixed engagement therewith. In this construction, the crankshaft 46 is driven by fixed engagement with the planet carrier 40, which transfers rotation thereto.

In the construction shown in FIG. 8, the drive assembly 22' includes a sun gear 38', a planet carrier 40' or cage, three planet gears 42', a ring gear 44', a crankshaft 46' having an eccentric member 48', a drive bushing 50', and two needle bearings 52'. The sun gear 38' is coupled to the drive shaft 20 of the motor 18 for rotation therewith. The planet gears 42' are driven by toothed engagement with the sun gear 38' and rotate about three stationary axes E. The planet gears 42' are supported by the planet carrier 40', which is fixed. The ring gear 44' is driven for rotation by the planet gears 42' by toothed engagement along an inner diameter of the ring gear 44'. The ring gear 44', in turn, drives the crankshaft 46' by way of toothed engagement between the inner diameter of the ring gear 44' and an outer diameter of the crankshaft 46'. The crankshaft 46' is supported for rotation within the head housing 14' by needle bearings 52'. The drive bushing 50' is disposed about the eccentric member 48', which is driven by the crankshaft 46' in an off-center manner about the axis A.

Figures 9A, 9B:
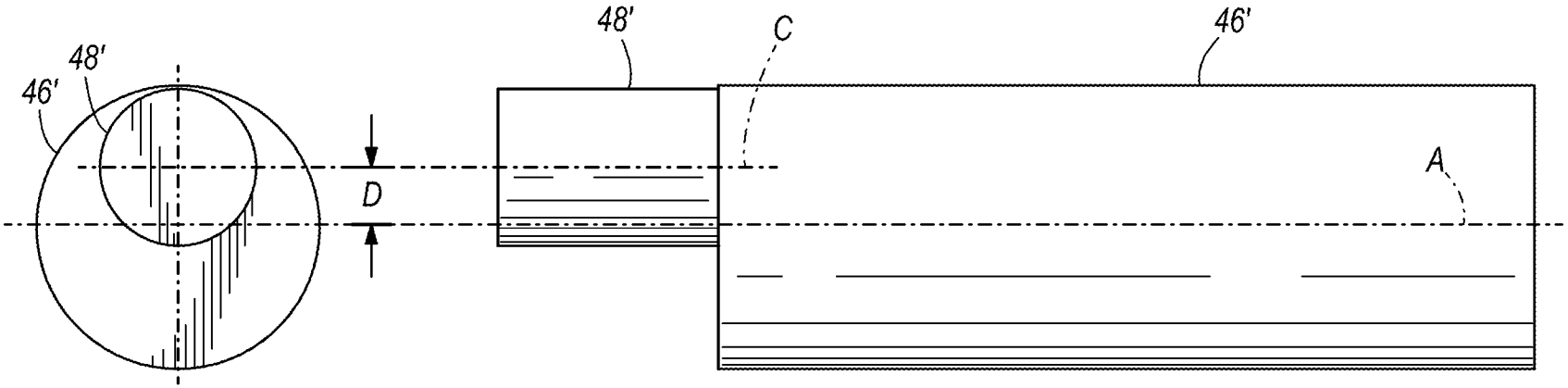
FIG. 9A is a schematic front view of a crankshaft of the powered ratchet wrench of FIG. 8.
FIG. 9B is a schematic side view of the crankshaft of FIG. 9A.

FIGS. 9A and 9B illustrate the crankshaft 46' and the eccentric member 48'. The eccentric member 48' defines a central axis C, which is parallel but not collinear with the axis A and is spaced from the axis A by a distance D, called the throw. The star gear arrangement described above, and shown in FIG. 8, is designed to minimize the throw D such that the head housing 14 more compactly accommodates the eccentric member 48' and the drive bushing 50'.

Figure 5:
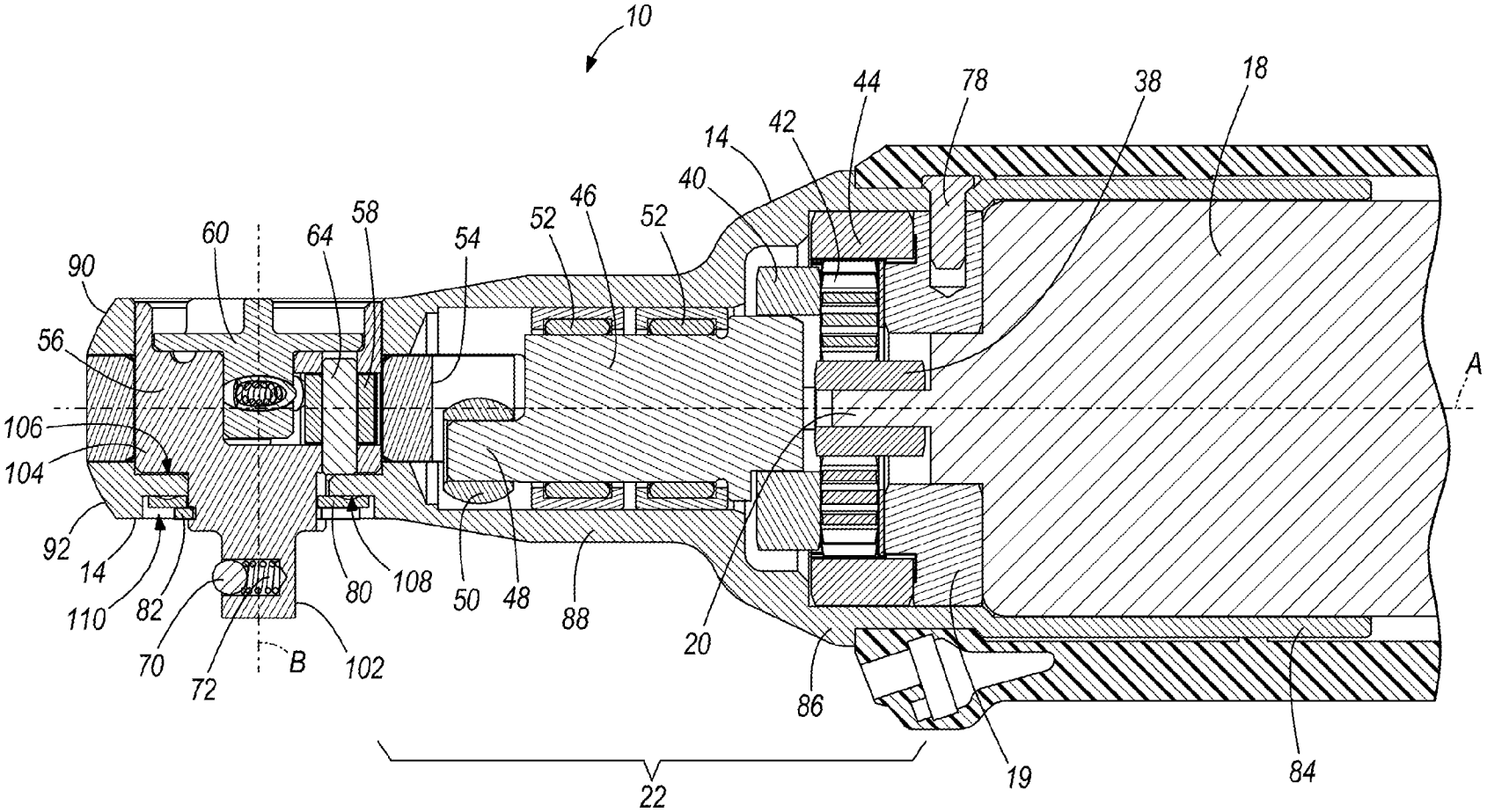
FIG. 5 is a cross-sectional view of a portion of the powered ratchet wrench taken along line 5-5 in FIG. 1.

With reference to FIGS. 2, 5 and 8, the output assembly 24 includes a yoke 54, an anvil 56 having an output member 102 (FIG. 10), such as a square head, for receiving sockets, a pawl 58 and a shift knob 60. In the illustrated construction, the output member 102 is a ¼ inch output member. In other constructions, the output member 102 may be other sizes such as ⅜ inch, or another suitable size. The yoke 54, anvil 56 and shift knob 60 are generally centered along the axis B. The output assembly 24 also includes a steel ball 62, a pin 64, a spring 66 and spring cap 68, a steel ball 70 and spring 72 for retaining sockets on the output member 102, four friction springs 74 and corresponding friction pins 76, a drive pin 78, friction plate 80 and retaining ring 82, as will be described in greater detail below. In other constructions, two, three or more friction springs 74 and corresponding friction pins 76 may be employed. The output assembly 24 is received in the head housing 14.

Figure 3:
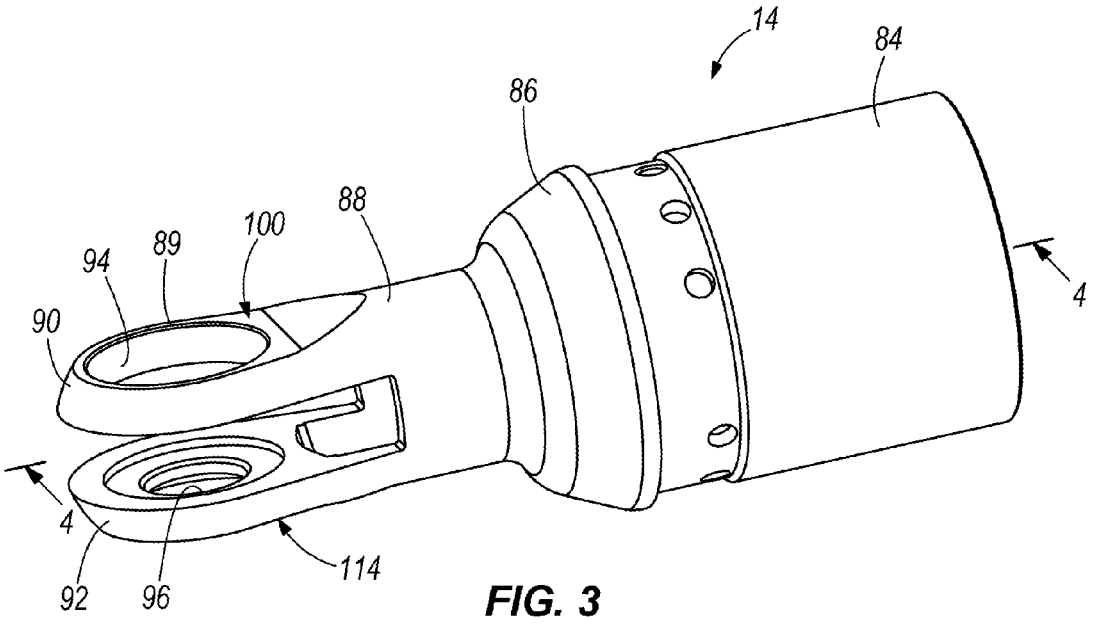
FIG. 3 is a perspective view of a head housing of the powered ratchet wrench of FIG. 1.
Figure 4:
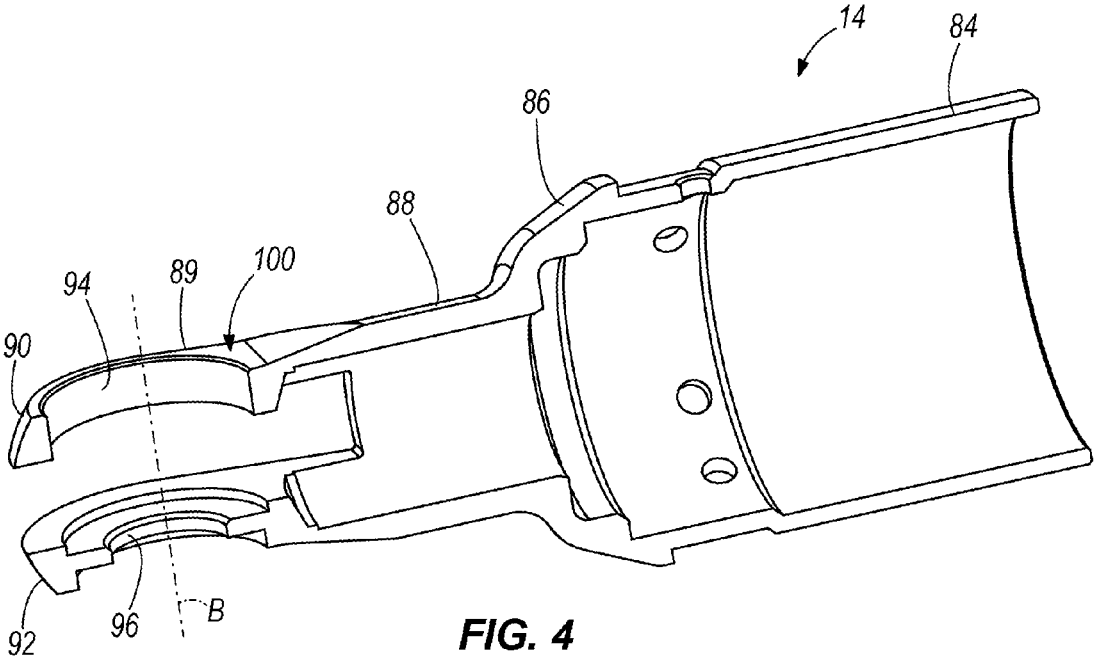
FIG. 4 is a perspective cross-sectional view of the head housing taken along line 4-4 in FIG. 3.

With reference to FIGS. 3-4, the head housing 14 is formed from steel as one piece and includes a cylindrical portion 84 that houses at least a portion of the motor 18, a shoulder portion 86 that houses the drive assembly 22, 22', a substantially cylindrical neck portion 88 that houses the crankshaft 46, 46' and eccentric member 48, 48', and a head portion 89 having a first ear 90 and second ear 92 that receive the output assembly 24 and, more specifically, receive the yoke 54. The head housing 14 is preferably nitro-carburized steel and is positioned adjacent the main housing 12. Steel is suitable for reducing flux losses in the motor 18. In other constructions, other metals suitable for reducing flux loss may be employed, e.g., other ferromagnetic materials. The shoulder portion 86, the neck portion 88 and the head portion 89 define an external surface 112 (FIG. 1) of the wrench 10, 10'. The main housing 12 further defines the external surface 112 and includes clamshell halves secured about the outer circumference of the cylindrical portion 84 by fasteners 85 (FIG. 2), such as flat head screws. The main housing 12 extends generally parallel to the axis A between the shoulder portion 86 and the battery pack 16 and abuts the shoulder portion 86 and the battery pack 16. As illustrated in FIG. 1, an aperture 136 in the main housing 12 receives a light emitting diode (LED) 138 for illuminating a workpiece, the aperture 136 and LED 138 generally facing the output member 102.

The first ear 90 includes a first aperture 94 and the second ear 92 includes a second aperture 96. The first and second apertures 94, 96 are centered about the axis B. The yoke 54 is received between the first and second ears 90, 92 in a direction perpendicular to axis B. The anvil 56 is received in the first and second apertures 94, 96 and the shift knob 60 is received in the first aperture 94. The first ear 90 includes an outer surface 100 facing away from the second ear 92. The shift knob 60 is fully recessed within the first ear 90 such that the shift knob 60 does not cross a plane defined by the outer surface 100 and is positioned entirely on a side of the outer surface 100 on which the output member 102 is located, as can be seen by the cross section views of FIGS. 5 and 8. The outer surface 100 is opposite and facing away from the output member 102.

With particular reference to FIGS. 5 and 8, the anvil 56 includes a shoulder 104 that abuts an inner surface 106 of the second ear 92. The inner surface 106 of the second ear 92 faces the first ear 90. The anvil 56 includes an annular recess that receives the retaining ring 82, which is disposed about an outer circumference of the anvil 56. The friction plate 80 abuts a recessed surface 108 of the second ear 92. The recessed surface 108 lies in a recess 110 in the second ear 92 defining a portion of the second aperture 96. The recessed surface 108 lies in a plane parallel to and positioned in between the inner surface 106 of the second ear 92 and an outer surface 114 of the second ear 92 facing the output member 102 and facing away from the first ear 90. The recessed surface 108 and the outer surface 114 lie parallel to the axis A. The first and second ears 90, 92 generally lie parallel to the axis A. The recessed surface 108 also faces the output member 102 and away from the first ear 90. This configuration secures the anvil 56 to the second ear 92.

Figure 7:
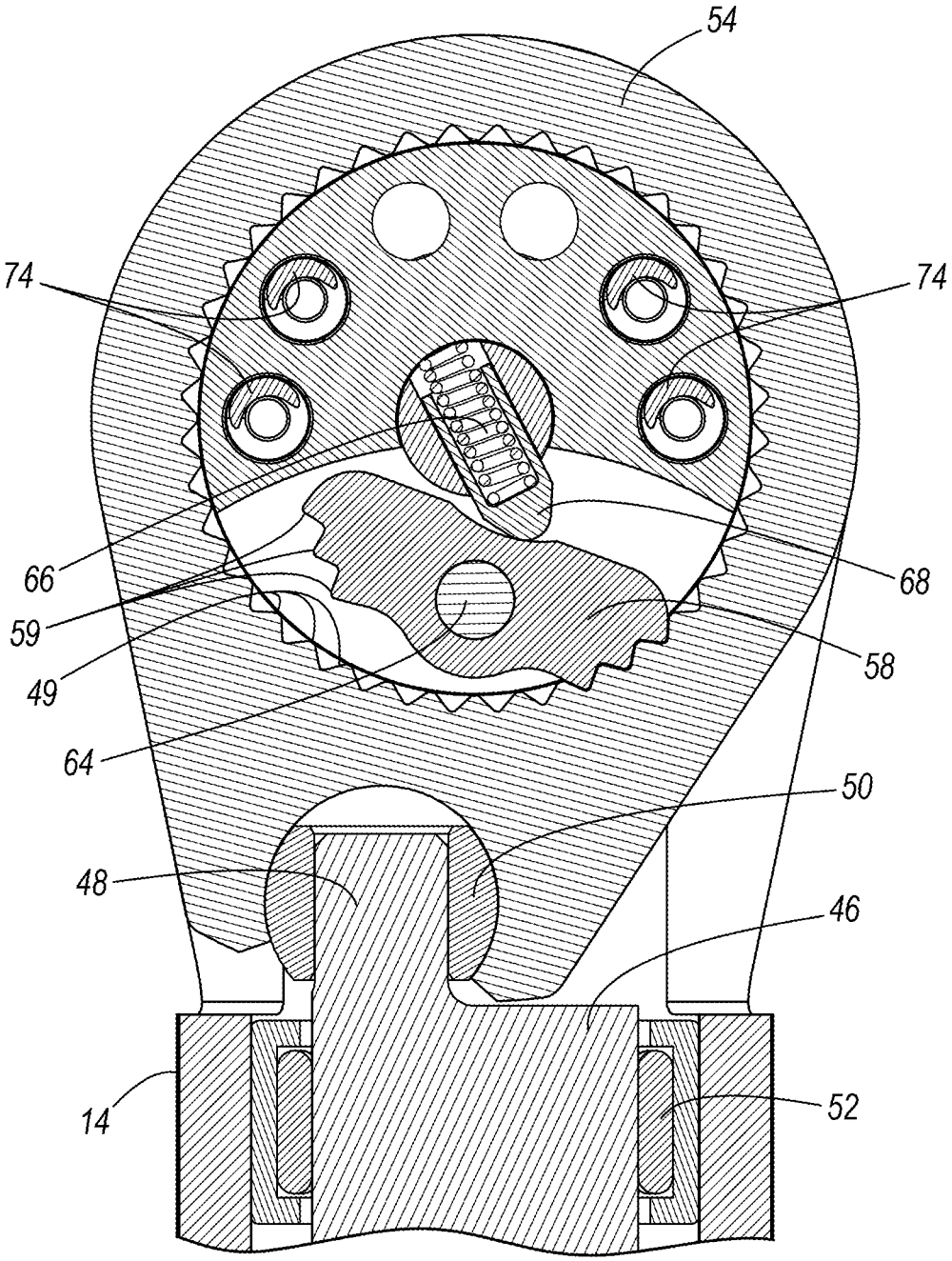
FIG. 7 is a cross-sectional view of a portion of the ratchet wrench taken along line 7-7 in FIG. 1.

In one construction of the wrench 10, 10', illustrated in FIG. 7, the output assembly 24 includes a single-pawl ratchet design. The pawl 58 is disposed between the first and second ears 90, 92. The yoke is oscillated between a first direction and a second direction about axis B by the eccentric member 48, 48'. An inner diameter of the yoke defined by an aperture includes teeth 49 (FIGS. 2 and 7) that mate with angled teeth 59 of the pawl 58 when the yoke 54 moves in the first direction. The yoke teeth 49 slide with respect to the angled teeth 59 of the pawl 58 when the pawl 58 moves in the second direction opposite the first direction such that only one direction of motion is transferred from the yoke 54 to the output member 102. The shift knob 60 cooperates with the spring 66 and the spring cap 68 to orient the pawl 58 with respect to the pin 64 such that the opposite direction of motion is transferred from the yoke 54 to the output member 102 when the shift knob 60 is rotated to a reverse position.

Figure 11:
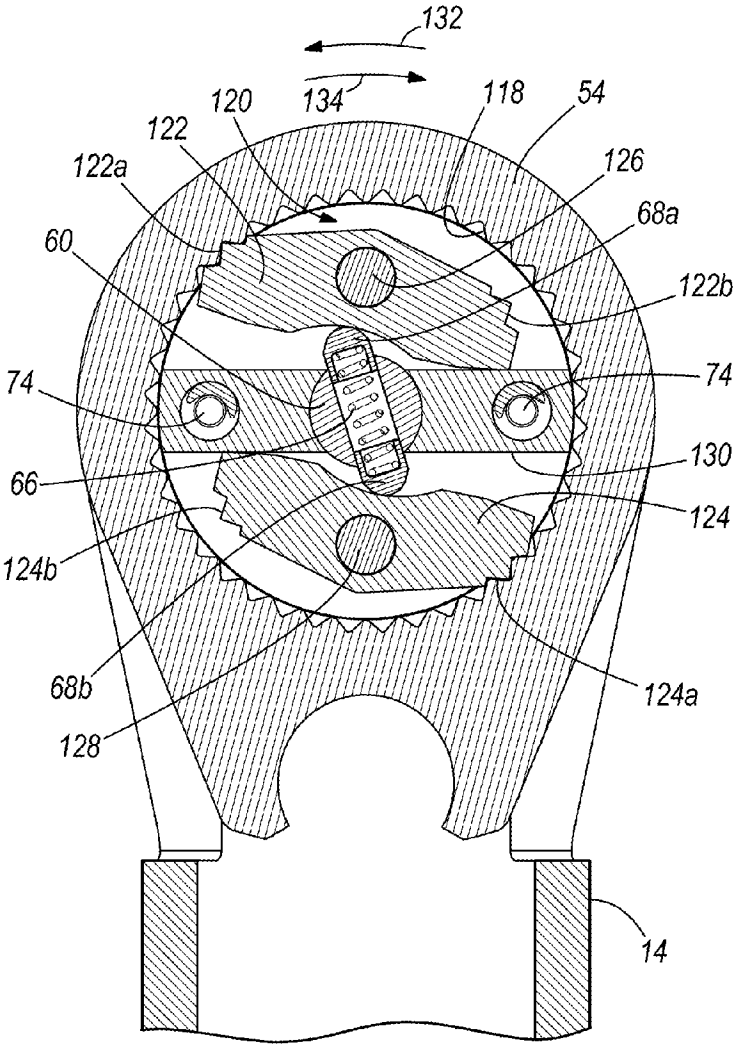
FIG. 11 is a cross-sectional view the powered ratchet wrench of FIG. 10 in a second position.
Figure 10:
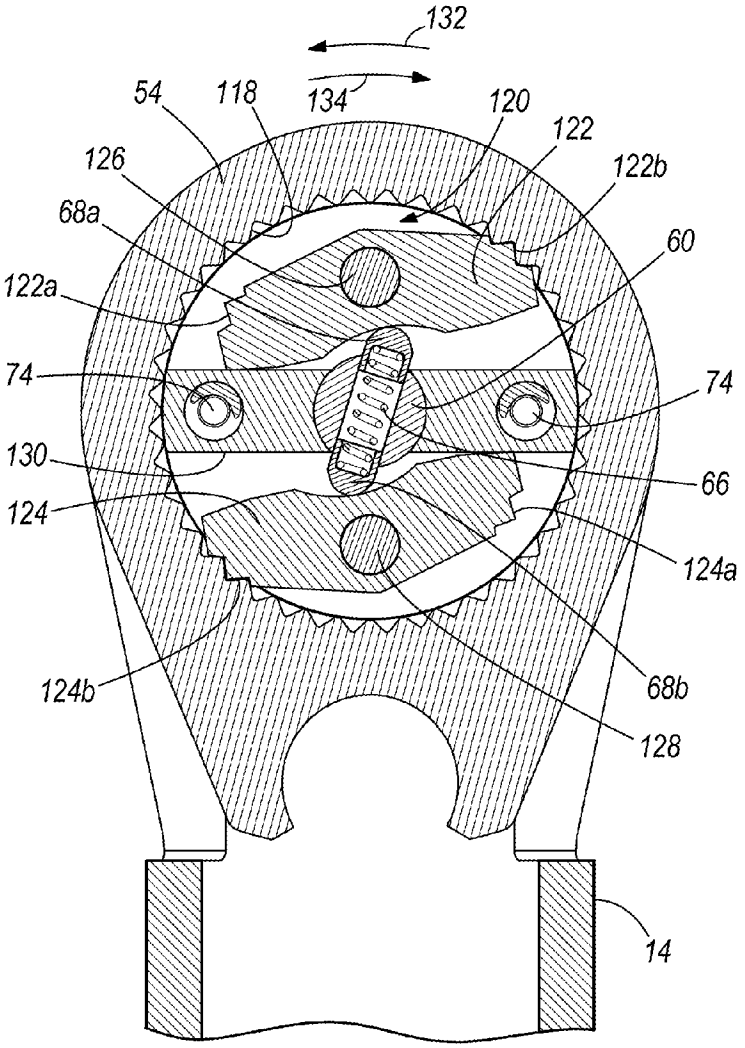
FIG. 10 is a cross-sectional view of another construction of a powered ratchet wrench, in a first position.
Figure 12:
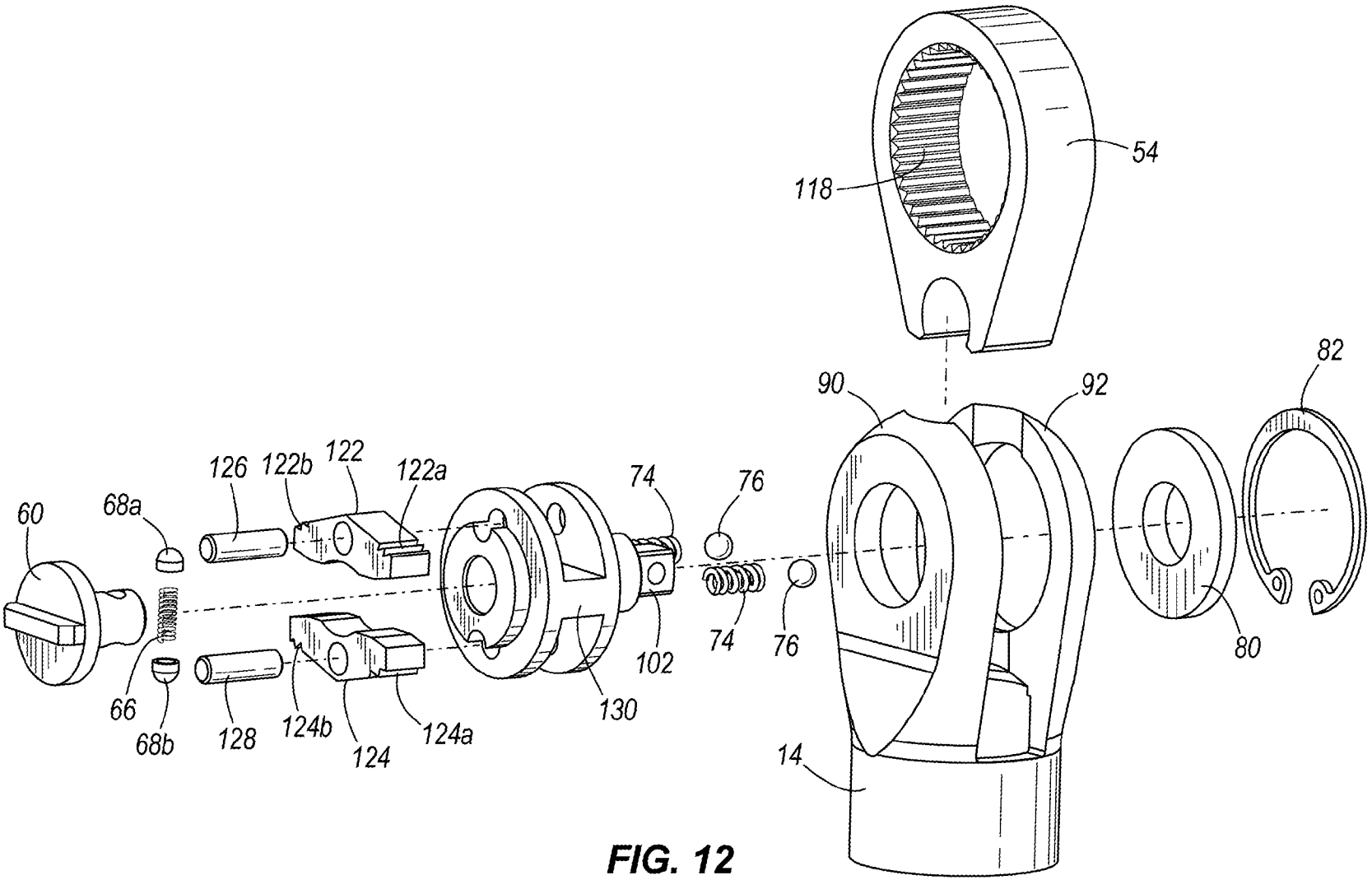
FIG. 12 is an exploded view of the portion of the powered ratchet wrench of FIGS. 10 and 11.

In another construction of the wrench 10, 10' shown in FIGS. 10-12, the output assembly 24 includes a dual-pawl design. In this construction, the yoke 54 includes a toothed inner surface 118 defining a central aperture 120. First and second pawl members 122, 124, respectively, are disposed in the central aperture 120 and include angled teeth 122*a*, 122*b* and 124*a*, 124*b*, respectively. Each of the first and second pawl members 122, 124 are disposed about pins 126, 128, respectively, that are fixed relative to the anvil 130. The spring 66 is a coil spring capped at each free end by a spring cap 68*a*, 68*b* (FIG. 12), respectively. The spring 66 and caps 68*a*, 68*b* are disposed in the shift knob 60 such that the spring 66 and caps 68*a*, 68*b* rotate about the axis B when the shift knob 60 is rotated. Spring caps 68*a*, 68*b* abut the first and second pawl members 122, 124, respectively.

When the shift knob 60 is in a first position, illustrated in FIG. 10, the angled teeth 122*b* and 124*b* engage the teeth 118 of the yoke 54. In the first position, the angled teeth 122*b* and 124*b* lock with the teeth 118 of the yoke 54 when the yoke 54 rotates in a first direction 132 and slide with respect to the teeth 118 when the yoke 54 rotates in a second direction 134 opposite the first direction. Thus, when the shift knob 60 is in the first position, the output member 102 rotates only in the first direction 132.

When the shift knob 60 is in a second position, illustrated in FIG. 11, the angled teeth 122*a* and 124*a* engage the teeth 118 of the yoke 54. In the second position, the angled teeth 122*a* and 124*a* engage the teeth 118 of the yoke 54 when the yoke 54 rotates in the second direction 134 and slide with respect to the teeth 118 when the yoke 54 rotates in the first direction 132. Thus, when the shift knob 60 is in the second position, the output member 102 rotates only in the second direction 134.

The use of two pawl members 122, 124 in the construction of FIGS. 10-12, instead of a single pawl, essentially cuts the loads on the pawl teeth in half, which substantially increases durability. Furthermore, the reaction forces between the pawls 122, 124, the yoke 54 and anvil 130 are balanced, which may improve efficiency. In other constructions, other types of ratchet mechanisms may be employed.

In operation, the operator actuates the switch paddle 28, which activates the motor 18 to provide torque to the output member 102. The user selects the direction of the shift knob 60 to provide the torque in a first direction (e.g., forward) or a second direction (e.g., reverse). The steel head housing 14 houses a substantial portion of the motor 18, which reduces flux losses, increases the motor efficiency and therefore the torque output. This eliminates the need for a separate flux ring, which reduces girth of the wrench 10, 10'. The head housing 14 may be employed in other types of power tools in addition to ratchet wrenches, such as impact drivers, drills, oscillating tools, and the like. The steel head housing 14, in which the motor 18, drive assembly 22 and output assembly 24 are supported, also reduces the part count of the wrench 10, 10' by providing a single housing for the head and motor of the tool. A portion of the housing 14, e.g., the cylindrical portion 84, is captured within the plastic clamshell handle of the main housing 12, which allows the main housing 12 to include a plastic grip portion without compromising strength. The portion of the housing 14 provides strength and stiffness not provided by the plastic main housing 12 alone. Thus, the one-piece steel head housing 14 also provides increased stiffness.

Furthermore, the housing 14 includes nitro-carburized heat treated steel, which provides high surface hardness to minimize wear, reduce friction and improve durability. The nitro-carburized surface, which forms a portion of the outer surface 112 of the tool, as described above, also provides excellent rust prevention and a durable black decorative finish such that no secondary coating or finish is required. Nitro-carburizing also results in less distortion than other heat treatment methods because of its lower processing temperature. Furthermore, the star gear arrangement of the drive assembly 22', illustrated in FIG. 8, reduces the throw D and eliminates the need for a bulge in the head housing 14, which increases the maneuverability of the wrench 10' with respect to a workpiece.

Thus, the invention provides, among other things, a rugged and compact powered ratchet wrench. Various features and advantages of the invention are set forth in the following claims.

What is claimed is:

1. A power tool comprising:

a motor having a motor drive shaft;

a drive assembly coupled to the motor drive shaft and driven by the motor;

an output assembly coupled to the drive assembly and having an output member;

a housing that houses at least a portion of the motor and at least partially defines an outer surface of the power tool, the housing formed from steel for reducing flux losses of the motor; and a main housing at least partially defining another outer surface of the power tool, wherein the main housing is disposed around an outer surface of a portion of the housing that houses the at least a portion of the motor.

2. The power tool of claim 1 wherein the portion is a substantially cylindrical portion.

3. The power tool of claim 2 wherein the housing includes a shoulder portion adjacent the substantially cylindrical portion, wherein the shoulder portion at least partially defines the outer surface of the power tool.

4. The power tool of claim 3 wherein the shoulder portion houses the drive assembly.

5. The power tool of claim 4 wherein the housing further includes a head portion that receives the output assembly.

6. The power tool of claim 1 wherein the main housing includes a grip portion.

7. The power tool of claim 2 wherein the main housing is disposed about an outer circumference of the substantially cylindrical portion of the housing.

8. The power tool of claim 1 wherein the portion is a substantially cylindrical portion, wherein the housing further comprises:

a neck portion at least partially housing the drive assembly; and a head portion at least partially receiving the output assembly;

wherein the substantially cylindrical portion, the neck portion, and the head portion are formed as a single piece.

9. The power tool of claim 8 wherein the neck portion is substantially cylindrical.

10. The power tool of claim 1 wherein the housing includes nitro-carburized steel.

11. The power tool of claim 1 wherein the output assembly further comprises:

a yoke coupled with an eccentric member for converting eccentric rotational motion of the eccentric member into oscillating rotational motion of the yoke;

wherein the output member is coupled to the yoke; and a ratchet mechanism disposed between the yoke and the output member for coupling the yoke to the output member in a first rotational direction and ratcheting the yoke with respect to the output member in a second rotational direction.

12. A power tool comprising:

a motor having a motor drive shaft;

a drive assembly coupled to the motor drive shaft and driven by the motor;

an output assembly coupled to the drive assembly and having an output member;

a head housing including a portion that houses at least a portion of the motor, a shoulder portion that houses the drive assembly and a head portion that at least partially receives the output assembly, wherein the head housing is formed as one piece, and wherein the head housing is formed from a metal; and a main housing disposed around an outer surface of the portion of the housing that houses at least a portion of the motor, wherein the main housing is formed from plastic and includes a grip portion.

13. The power tool of claim 12 wherein at least one of the shoulder portion and the head portion at least partially defines an outer surface of the power tool.

14. The power tool of claim 12 wherein the motor is an electric motor and wherein the head housing is formed from steel for reducing flux losses of the motor.

15. The power tool of claim 12 wherein the output assembly is a ratchet wrench output assembly including a yoke, and wherein the head portion includes a first ear and a second ear that receive the yoke therebetween.

16. The power tool of claim 12 wherein substantially cylindrical portion is substantially cylindrical, and wherein the main housing includes two clamshell halves secured around an outer circumference of the substantially cylindrical portion and substantially enclosing the substantially cylindrical portion.

17. A power tool comprising:

a motor having a motor drive shaft;

a drive assembly coupled to the motor drive shaft and driven by the motor, the drive assembly including an eccentric member;

an output assembly coupled to the drive assembly, the output assembly including:

a yoke coupled with the eccentric member for converting eccentric rotational motion of the eccentric member into oscillating rotational motion of the yoke;

an output member coupled to the yoke; and a ratchet mechanism disposed between the yoke and the output member for coupling the yoke to the output member in a first rotational direction and ratcheting the yoke with respect to the output member in a second rotational direction;

a housing having a portion for at least partially enclosing the motor and a head portion for at least partially receiving the yoke, wherein the portion for at least partially enclosing the motor and the head portion for at least partially receiving the yoke are formed as one piece; and a main housing having a grip portion, wherein the portion for at least partially enclosing the motor is substantially enclosed by the main housing.

18. The power tool of claim 17 wherein the motor is an electric motor, and wherein the housing is formed from steel for reducing flux losses of the motor.

19. The power tool of claim 18 wherein the housing includes nitro-carburized steel.

20. The power tool of claim 17 wherein the head portion of the housing at least partially defines an outer surface of the power tool.

21. The power tool of claim 17 wherein the portion is for at least partially receiving the motor is substantially cylindrical, and wherein the head portion includes a first ear and a second ear for receiving the yoke therebetween.

* * * * *